US006265035B1

(12) United States Patent
Sniderman

(10) Patent No.: US 6,265,035 B1
(45) Date of Patent: Jul. 24, 2001

(54) MULTI-PIECE, MULTI-FUNCTIONAL ORNAMENT

(75) Inventor: Jon H. Sniderman, Saline, MI (US)

(73) Assignee: Ornette Enterprises, Saline, MI (US)

( * ) Notice: Subject to any disclaimer, the term of this patent is extended or adjusted under 35 U.S.C. 154(b) by 0 days.

(21) Appl. No.: 09/430,159

(22) Filed: Oct. 29, 1999

(51) Int. Cl.[7] ..... A47G 33/04

(52) U.S. Cl. ..... 428/11; 428/7; 428/14; 428/101; 428/187; 428/542.2; 156/250; 40/584; D11/97

(58) Field of Search ..... 428/14, 7, 28, 428/11, 187, 542.2, 101; 156/250; D11/95, 97; D20/10; 40/584, 210

(56) References Cited

U.S. PATENT DOCUMENTS 94,632 * 9/1869 Murfey .
D. 161,159 * 12/1950 Burros .
D. 305,335 * 1/1990 Wood et al. ..... D20/11
D. 367,730 * 3/1996 Chiavetta ..... D28/99
1,125,423 * 1/1915 Wiley .
2,067,528 * 1/1937 Greene .
2,076,387 * 4/1937 Stupell .
5,472,751 * 12/1995 Pyron et al. ..... 428/28

* cited by examiner

*Primary Examiner*—Deborah Jones
*Assistant Examiner*—Abraham Bahta
(74) *Attorney, Agent, or Firm*—Young & Basile, P.C.

(57) ABSTRACT

A multi-piece ornament includes an outer frame, a design piece and a negative. The design piece, negative, and frame are cut from a flat blank of material in nested, preferably concentric fashion so there is little or no waste in material. The design piece is cut from within the negative and removed therefrom to define an ornamental design cutout in the negative. The three pieces may be arranged separately or in different combinations to form a hanging ornament, for example wherein the design piece is suspended within the frame and the negative and the frame are suspended one from the other. The three pieces may alternatively be affixed to a plaque or other display surface with the design piece within and surrounded by the frame, and the negative outside of and adjacent the frame.

13 Claims, 4 Drawing Sheets

12
12a
14
14a
16

10
12a
12
16
18
18
20
22
14
24

MULTI-PIECE, MULTI-FUNCTIONAL ORNAMENT

FIELD OF THE INVENTION

The present invention relates to decorative ornaments and to a method of making a multi-piece ornament.

BACKGROUND OF THE INVENTION

Hanging ornaments are used to decorate living and work spaces. Such ornaments may be suspended from Christmas trees, ceilings, or any other appropriate object. Most ornaments are, however, single-purpose: Christmas tree ornaments intended to hang from a branch; stand-mounted ornaments intended for upright placement on mantels, shelves, or tables; plaque type ornaments for hanging on the wall. Moreover, most ornaments offer only one ornamental appearance or configuration.

Additionally, many ornaments are both bulky and fragile, making storage difficult and space consuming.

SUMMARY OF THE INVENTION

In carrying out the present invention, a multi-piece ornament comprises an outer frame, a generally two-dimensional design piece having a desired ornamental outline, and a "negative" having a cutout matching the outline of the design piece. According to the invention, the design piece is cut from the negative and removed therefrom to define the cutout in the negative, and the negative is cut from within the frame. The design piece, the negative and the frame are cut from a single blank of material in nested, preferably concentric fashion so that the three pieces can be mixed, matched, and mated in different combinations for packaging and display. Little or no material is wasted when manufacturing the ornament with this nested cutout method.

In a first application of the invention, the design piece is suspended within the frame, minus the negative. Further, the negative can be suspended from the frame. This arrangement creates an attractive hanging ornament in which an ornamental design is displayed both by the design piece and by the design-shaped cutout in the negative.

In a second application of the invention, the frame and design piece are affixed to a display surface with the design piece within and surrounded by the frame, and the negative is affixed to the display surface adjacent and below the frame.

Further advantages and applications of the present invention will become apparent to those skilled in the art when the following description of the best mode contemplated for practicing the invention is read in conjunction with the accompanying drawings.

BRIEF DESCRIPTION OF THE DRAWINGS

The following description makes reference to the accompanying drawings wherein like reference numerals refer to like parts throughout the several views, and wherein.

DESCRIPTION OF THE PREFERRED EMBODIMENT

Figure 1:
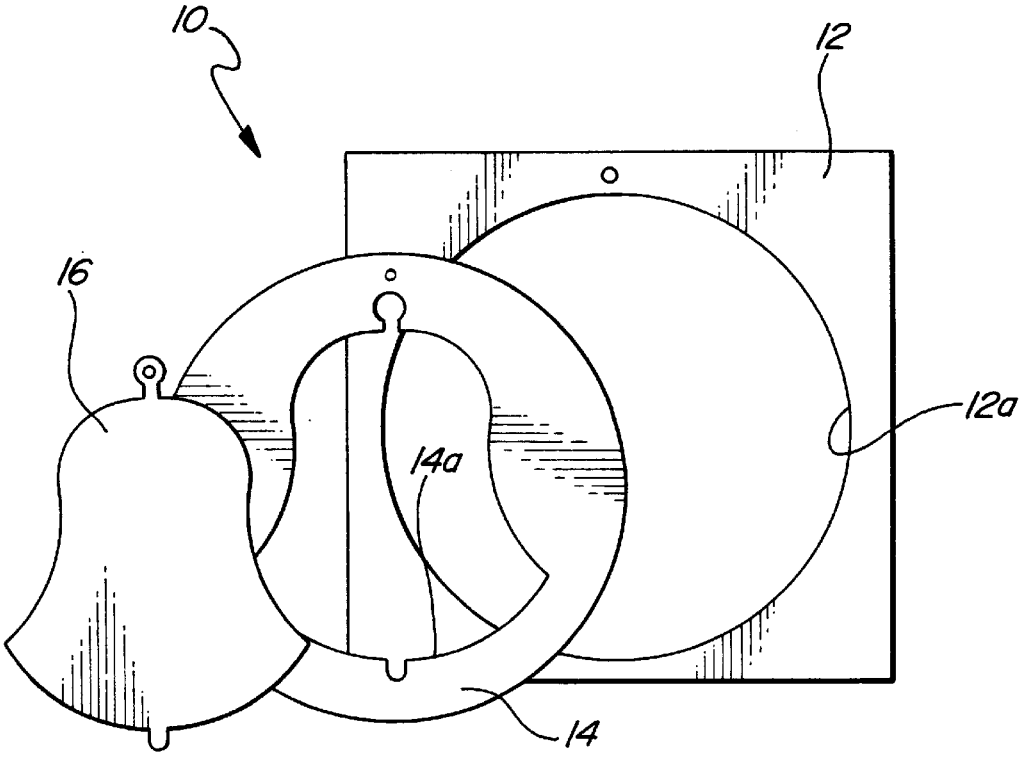
FIG. 1 is an exploded view showing the three components of an ornament according to the present invention, in metal, after the components have been cut from a blank.

As seen in FIG. 1, a multi-piece ornament 10 according to the present invention comprises a rectangular frame 12, a circular negative 14 cut from within the frame 12, and a bell-shaped design piece 16 cut from within the negative 14. The three pieces 12,14,16 of the ornament 10 are cut in nested, preferably concentric fashion from a single blank of thin metal, such as cold rolled steel, with the outline of the design piece 16 being an identical "positive" to the cutout 14*a*in the negative 14, and with the outline of the negative 14 matching the cutout 12*a* of the frame 12.

In the depicted embodiment of the invention, the frame 12 is square and the negative 14 is circular, but these pieces may be of any shape to achieve a desired aesthetic appearance. The design piece 16 also may be of any desired ornamental shape, the bell illustrated in FIG. 1 and the cross illustrated in FIG. 4 being only two examples. The preferred dimensions for the ornament 10 is on the order of four inches square, but other sizes are within the scope of the invention.

The blank from which the three pieces 12,14,16 are cut is preferably substantially flat or two-dimensional and may be any suitable material, for example wood, metal, or plastic. The blank may be cut using any method and apparatus appropriate for the particular material, however a laser cutting device has been found to be effective for cutting both wood and metal.

Figures 2, 2A:
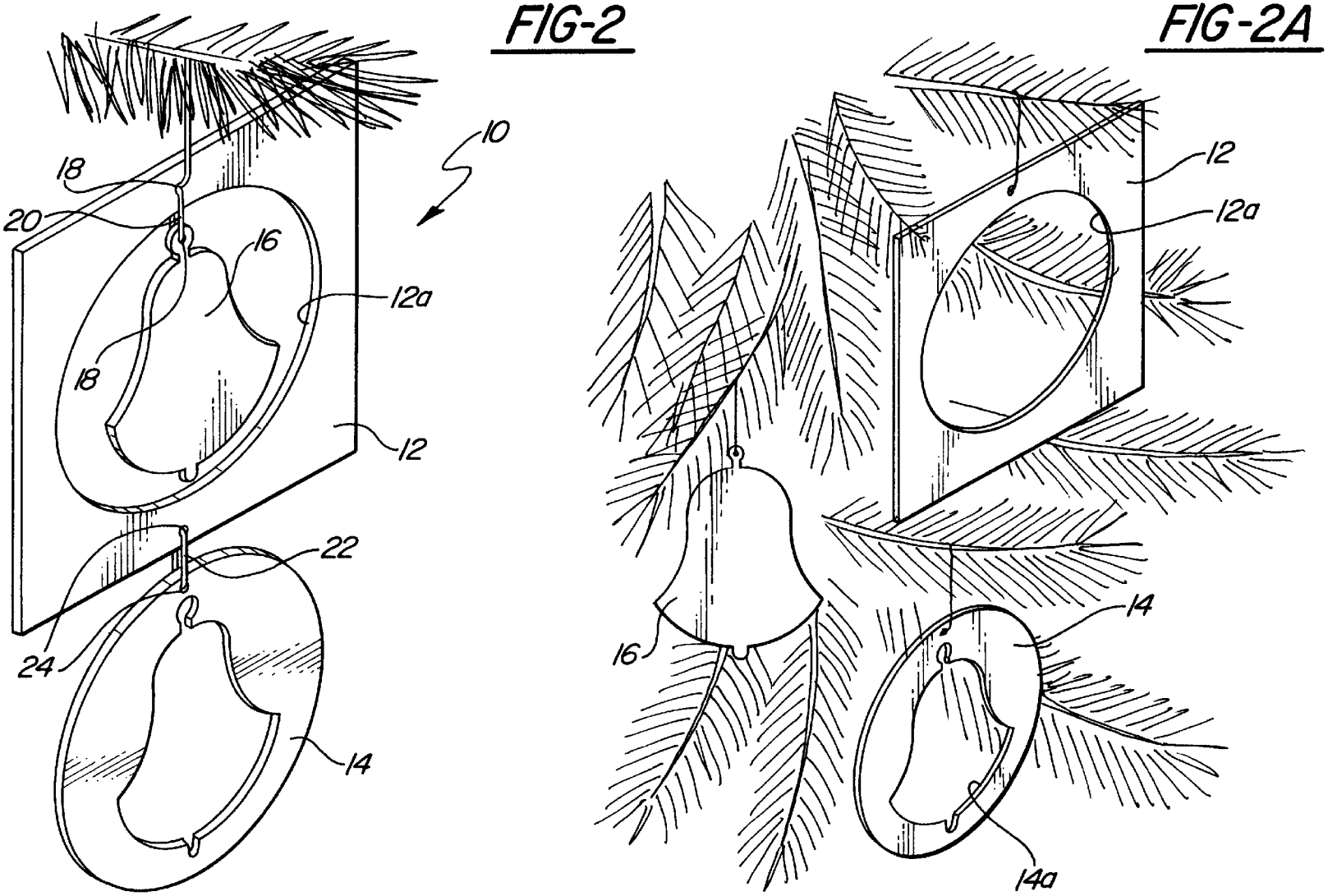
FIG. 2 is a perspective view of the ornament of FIG. 1 displayed as a hanging Christmas tree ornament.
FIG. 2A illustrates the components of the ornament of FIG. 2 hanging independently on a Christmas tree in a grouping.

As seen in FIG. 2, multi-piece hanging ornament 10 is displayed by suspending the design piece 16 within cutout 12*a* of frame 12 and suspending the negative piece 14 below frame 12. Small suspension holes 18 are formed through frame 12 and design piece 16 adjacent the top edges thereof, and a small loop 20 of flexible material engages the holes to suspend the design piece 16 within frame 12. Similarly, a loop 22 engages suspension holes 24 formed adjacent the lower edge of frame 12 and the upper edge of negative 14 to suspend negative 14 below frame 12. The resulting three-piece ornament 10 may be suspended from a ceiling, a lamp, a tree branch, or any suitable object such that the three pieces 12,14,16 are able to move relative to one another and create a pleasing visual effect.

Alternatively, the vertical order of the pieces may be reversed, with frame 12 and design piece 16 suspended below negative 14.

Additional decoration may be added to any of the three pieces 12,14,16, such as by applying paint, enamel, or decals to the surface of one or more of the pieces. The surfaces of pieces 12,14,16 may also be textured, for example by blasting with shot or sand.

Figure 1A:
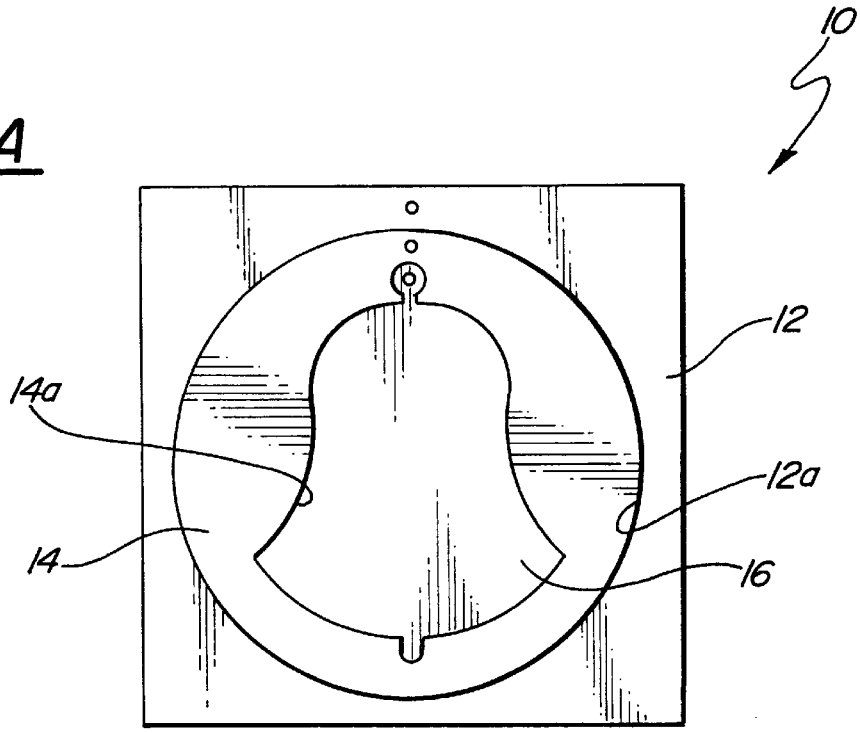
FIG. 1A illustrates the three components of FIG. 1 in an assembled, nested arrangement.

In addition to the foregoing advantages, the suspension of the ornament pieces in the manner shown in FIG. 2 creates not only a pleasing visual effect but a three-dimensional effect using what are nominally the pieces of a two-dimensional ornament. As best shown in FIG. 1A, the ornament can be packaged flat, such that it takes up no more space than a drink coaster, for example. However, when unpacked, separated, and reassembled in one of several possible combinations, the ornament actually achieves three-dimensional ornament effect, particularly if the suspension of the pieces relative to one another is allowed some degree of rotation or swinging. It will be understood that the wire loops illustrated in FIG. 2 as one possible example of suspension means can be replaced with string, elastic cord, rubber bands, small swivel hooks or chains, and other known structure for hanging small items to allow some degree of movement. This allows a single ornament according to the present invention to have a "multiplier" effect in that not only can a single ornament be converted into three separate ornaments or various combinations of two or more pieces, but the different arrangements of the ornaments may catch the light differently, move differently when suspended, and generally accomplish the effect of more than one typical ornament. For example, as best visualized by referring to FIG. 2A, pieces 12, 14, and 16 could be applied to a Christmas tree as three separate ornaments, provided the surface finish and color gave each of them a suitably decorative effect. The juxtaposition of three fully-separated pieces 12, 14, 16 from a single nested three-piece ornament according to the invention can create a pleasing visual effect because all three pieces, although separated on the tree, are related to one another.

Figure 3:
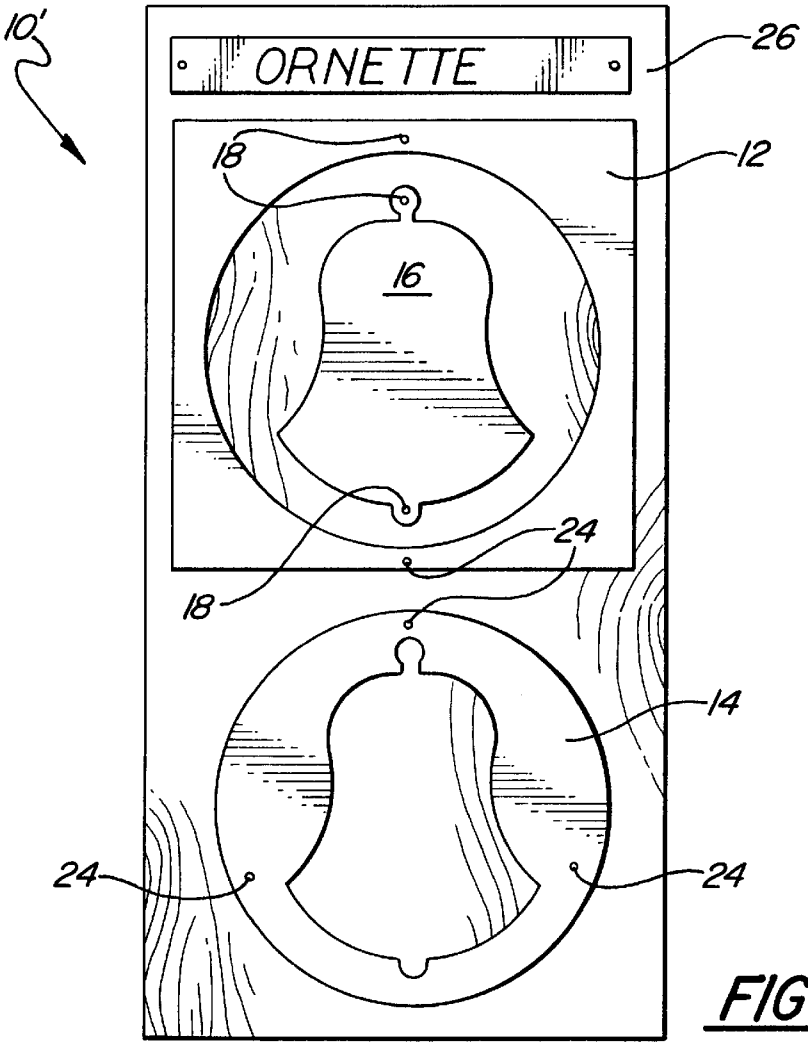
FIG. 3 is a front view of the metal ornament of FIG. 1 displayed on a wooden plaque.

In an alternative embodiment of the invention seen in FIG. 3, an ornament 10' comprises three pieces 12,14,16 substantially identical to those described above but affixed to a display surface 26 such as a wooden plaque. The frame 12 and design piece 16 are affixed to the display surface 26 with the design piece 16 centered within and surrounded by frame 12, and the negative 14 is affixed to the display surface 26 outside of and adjacent to the frame 12. The pieces 12,14,16 may be affixed to the surface 26 by any suitable method, such as adhesive or small nails passing through the holes 18,24 formed in the pieces. If desired, other decorative or descriptive objects may also be affixed to the display surface 26, such as a metal plate 28 bearing an inscription.

Figure 4:
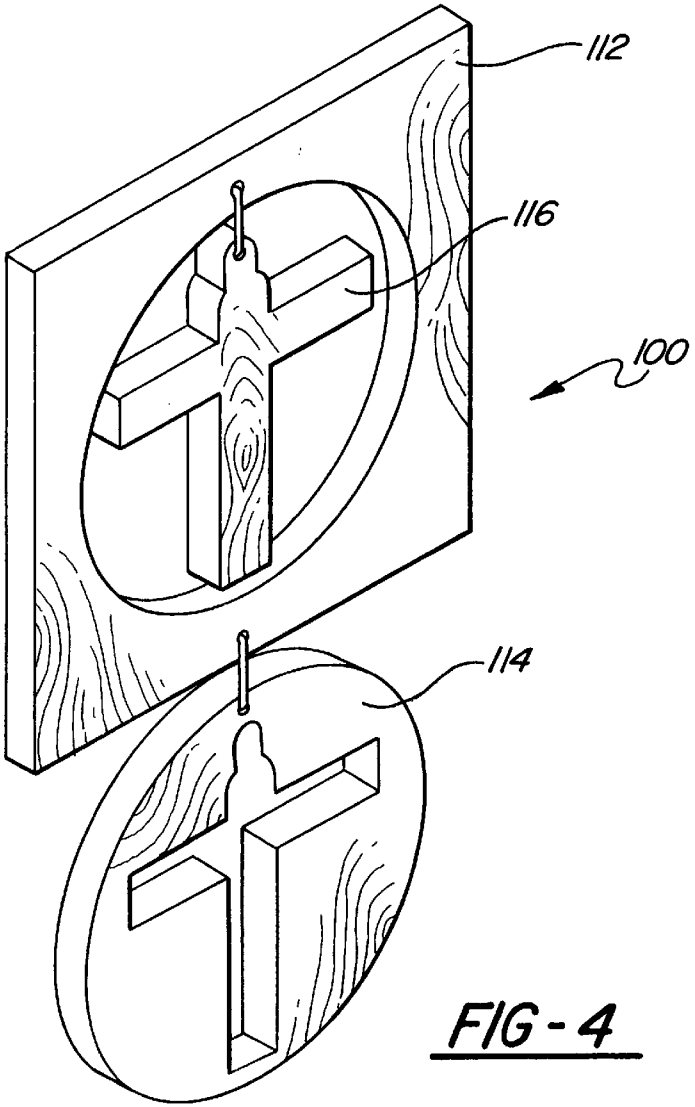
FIG. 4 is a perspective view of a wooden ornament according to the invention, displayed as a hanging ornament.

As seen in FIG. 4, an ornament 100 according to the invention is illustrated as formed from a wooden blank rather than metal. The three pieces 112,114,116 are cut in the same nested, preferably concentric fashion described above, and may be displayed either as a hanging ornament as in FIG. 4 or by affixing them to a display surface. It has been found that an attractive ornament can be conveniently made from wood approximately ⅜" to ¾" thick.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. For example, while the invention has been illustrated as a three-piece ornament, ornaments with more than three pieces can also be made according to the invention.

Figure 6:
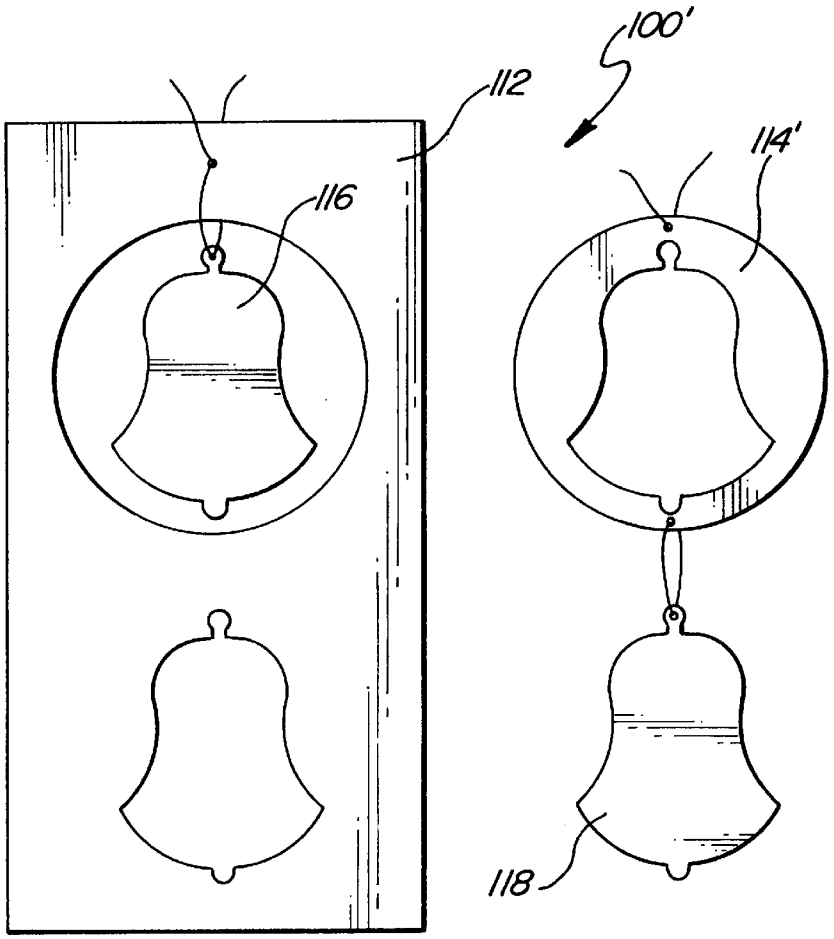
Figure 5:
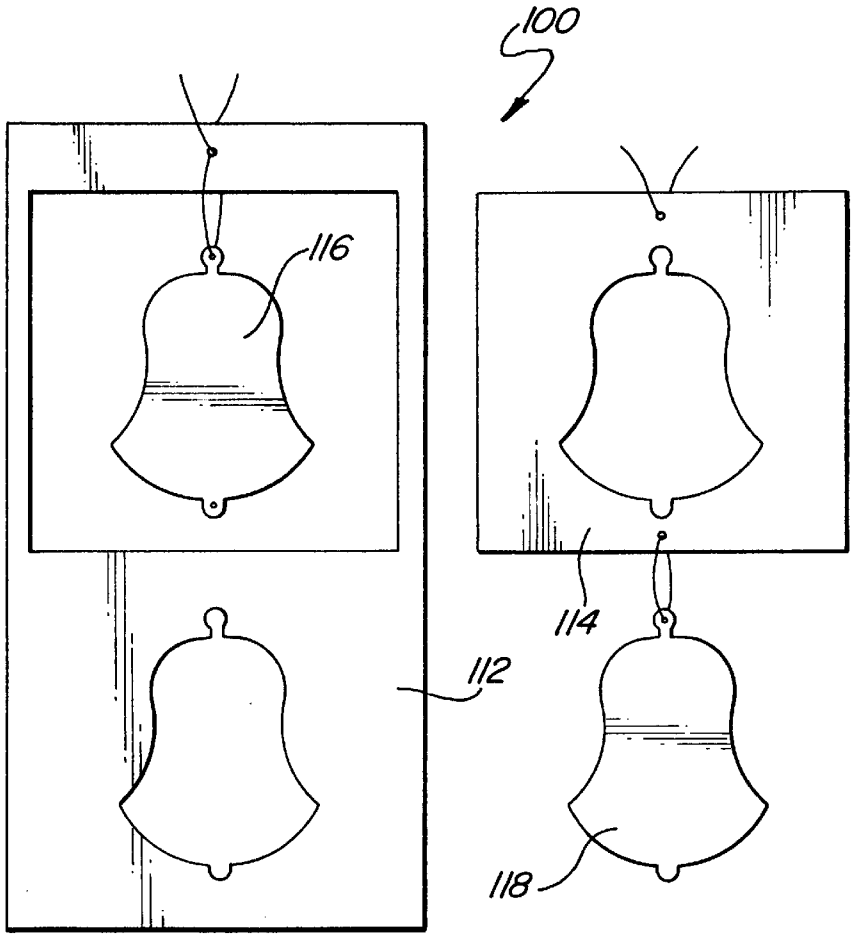

Referring to FIGS. 5 and 6, four-piece embodiments of the invention are illustrated. In FIG. 5, an ornament 100 with an extended, rectangular frame 112 has a squared negative 114, a bell-shaped design piece 116 cut from negative 114, and a secondary design piece 118 cut directly from extended frame 112 and preferably similar or identical to design piece 116 above. This novel four-piece arrangement allows for a pleasing two-by-two hanging arrangement as shown.

FIG. 6 is similar to FIG. 5, except that negative 114' is circular. Both the FIG. 5 and FIG. 6 ornaments are illustrated as made from a flat metal blank.

The invention claimed is:

1. A multi-piece ornament formed from a substantially flat blank, comprising:

a frame having a perimeter;

a negative having an outline cut from within the frame, the negative being removable from the frame; and, a design piece having an ornamental outline cut from within and removable from the negative, such that the negative contains a cutout matching the ornamental outline of the design piece, wherein the frame, the design piece, and the negative are capable of being removably nested in flat, coplanar fashion and are further capable of being separated from one another for use singly or in differing combinations.

2. The ornament of claim 1 wherein the design piece is removably suspended within the negative cutout in the frame and the negative is removably suspended from the frame or the frame is removably suspended from the negative.

3. The ornament of claim 1 wherein the frame is affixed to a display surface, the design piece is affixed to the display surface within the negative cutout of the frame, and the negative is affixed to the display surface adjacent to the frame.

4. A method of making a multi-piece ornament comprising the steps of:

providing a substantially flat blank having a perimeter;

cutting through the blank to define a removable negative surrounded by a frame and to form a matching negative cutout in the frame;

cutting through the negative to define a removable design piece surrounded by the negative and to form a matching design cutout in the negative.

5. The method of claim 4, further including the steps of separating the negative from the frame and the design piece from the negative, displaying the design piece within the negative cutout in the frame, and displaying the negative adjacent the frame.

6. The method of claim 5 wherein the displaying steps comprise:

suspending the design piece removably within the negative cutout of the frame; and suspending one of the negative and the frame removably from the other of the negative and the frame.

7. The method of claim 5 wherein the displaying steps comprise:

affixing the frame to a display surface;

affixing the design piece to the display surface within the negative cutout of the frame; and affixing the negative to the display surface adjacent the frame.

8. A method of making a hanging ornament comprising the steps of:

providing a substantially flat blank having a perimeter;

cutting through the blank to define a removable, substantially flat negative surrounded by a substantially flat frame and to form a negative cutout in the frame;

cutting through the negative to define a removable, substantially flat design piece having an ornamental outline surrounded by the negative and forming a design cutout in the negative matching the ornamental outline of the design piece;

suspending a combination of two or more of the substantially flat frame, negative, and design piece from one another in removable fashion.

9. The method of claim 8, further comprising the step of suspending the combination from an ornament-supporting object.

10. The method of claim 8, wherein the step of suspending the combination includes the step of suspending one of the two or more of the substantially flat frame, negative and design piece such that it is free to move for a three-dimensional effect.

11. The ornament of claim 1, wherein the outline of the negative cut from within the frame leaves the frame with a cutout matching the negative outline.

12. The ornament of claim 1, wherein the ornamental outline cut from within the negative is of a different design than the negative outline cut from within the frame.

13. The ornament of claim 1, wherein the frame, the negative, and the design piece each includes means for removably suspending one from the other or from an external support.

* * * * *